United States Patent [19]

Filiz et al.

[11] Patent Number: 4,685,558

[45] Date of Patent: Aug. 11, 1987

[54] COSMETIC COMPACT WITH PINLESS INTERNAL HINGE

[75] Inventors: Alain Filiz, New York, N.Y.; Salvatore J. Ascolese, Edison, N.J.

[73] Assignee: L'Oreal, S.A., France

[21] Appl. No.: 850,233

[22] Filed: Apr. 10, 1986

[51] Int. Cl.[4] ..... A45C 13/10

[52] U.S. Cl. ..... 206/1.5; 206/235; 206/581; 206/823; 220/DIG. 26; 132/79 F; 132/79 G; 132/83 R; 292/DIG. 37

[58] Field of Search ..... 206/1.5, 37, 235, 581, 206/823; 220/342, 343, DIG. 26; 132/79 G, 83 R, 82 R, 79 F; 292/86, 170, DIG. 37, DIG. 50; 190/119, 121

[56] References Cited

U.S. PATENT DOCUMENTS

| | | | |
|---|---|---|---|
| 1,926,839 | 9/1933 | Denels | 220/DIG. 26 |
| 2,195,593 | 4/1940 | Kreisler | 220/DIG. 26 |
| 2,203,202 | 6/1940 | Kun | 220/DIG. 26 |
| 2,245,487 | 6/1941 | Machin | 220/343 |
| 2,246,705 | 6/1941 | Tyres | 220/343 |
| 2,278,866 | 4/1942 | Dell'Elba | 220/DIG. 26 |
| 2,371,557 | 3/1945 | Sullivan | 220/342 |
| 2,826,280 | 3/1958 | Dorfman | 220/342 |
| 3,560,037 | 2/1971 | Crain | 292/170 |
| 4,132,306 | 1/1979 | Margolin | 220/DIG. 26 |
| 4,331,168 | 5/1982 | Hatakiyawa | 220/DIG. 26 |
| 4,392,503 | 7/1983 | Watanabe | 132/83 R |
| 4,522,288 | 6/1985 | Weikman et al. | 190/115 |

*Primary Examiner*—Stephen Marcus
*Assistant Examiner*—David T. Fidei
*Attorney, Agent, or Firm*—Brumbaugh, Graves, Donohue & Raymond

[57] ABSTRACT

A compact includes a cover which is hinged to the base by a hinge which includes a helical coil spring which is tensed by closing of the cover for storing energy that forces the cover open when the cover is released for opening. The closure for the compact includes a subassembly of a button, an apertured locking element and a pair of runners which cooperate with stops in the bottom of the base so that as a locking pin in the cover passes through the aperture in the locking element, the subassembly is effectively depressed and the runners are flexed for storing energy in the runners which thereafter restores the subassembly to its undepressed state with the pin locked in the locking element. The subassembly operates similarly to be self-restoring when the button is depressed for unlocking the pin whereby the bias provided by the coil springs the cover open.

5 Claims, 3 Drawing Figures

COSMETIC COMPACT WITH PINLESS INTERNAL HINGE

This invention relates to a personal container for cosmetics, or a compact.

BACKGROUND OF THE INVENTION

Compacts used to house cosmetics need to be attractive since they are often used in public, rugged since they have to withstand dropping, easy to open and close since they should be convenient to use, and relatively inexpensive since they typically are not reused after the original contents are used up.

A wide variety of compacts are currently in use. Typically such a compact comprises a base or container portion and a cover portion. The container portion houses the cosmetic, which may be either a powder or a paste, and also usually an applicator, which may be either a powder puff or a brush. The cover portion typically houses a mirror for use when the cosmetic is being applied. Generally the two portions are hinged together so that even in the open position of the compact they are not completely separated. Often the hinge is a simple unbiased hinge that maintains the separation which is set by the user when opening the compact. However it is known to associate a leaf spring with the hinge to bias the hinge in favor of the open position but this has been troublesome because of difficulty in achieving reproducible control inexpensively. Such a bias is useful in facilitating opening of the compact, particularly for the user with poor manual dexterity. Additionally, the compact includes a closure for locking the two portions together in a closed position when the compact is not being used. Typically, the closure includes a pin which is located in the cover which in closing is made to lock in an opening in the base. For opening, manual pressure is applied to depress a button which unlocks the pin. It has proven troublesome in the past to provide an inexpensive closure which works reliably with a hinge which includes a leaf-spring.

SUMMARY OF THE INVENTION

In a compact in accordance with the present invention, the hinge assembly of the compact includes a helical coil spring member arranged to provide a bias favoring opening of the compact upon release of the closure to facilitate the initial opening of the compact. In its preferred form, the coil spring is of a special type involving a V-shaped enlarged end turn.

Additionally for cooperating with such a hinge, the compact employs a novel closure which is reliable and relatively inexpensive to fabricate. In particular, the closure includes a subassembly, which can be molded as a single piece part, comprising a button, a locking element, and a pair of flexible runners or guides on opposite sides of the locking element. This subassembly is supported in an opening in a wall of the base portion and slides in the opening when the button is depressed. The bottom of the base is provided with a plurality of stops which limit the travel of the assembly when the button is depressed. Additionally as the button is depressed, the stops serve to spread the runners apart, so that when the button is released, the flexed runners tend to unflex, thereby restoring the subassembly to its undepressed position. In this compact, as the cover is closed, a notched pin in the cover is pushed past an aperture in the locking member, thereby sliding the subassembly in as though the button was being depressed. However, once the pin has passed through the aperture, the pushing force on the subassembly is relieved and it restores itself to its undepressed position, as discussed previously. However, now the pin is held in the locking element by its notch and the cover stays closed until the button is depressed to release the pin. When the button is depressed, sliding the subassembly in and unlocking the pin, the spring action of the hinge discussed earlier easily overcomes gravitational forces and the cover springs open.

Figure 2:
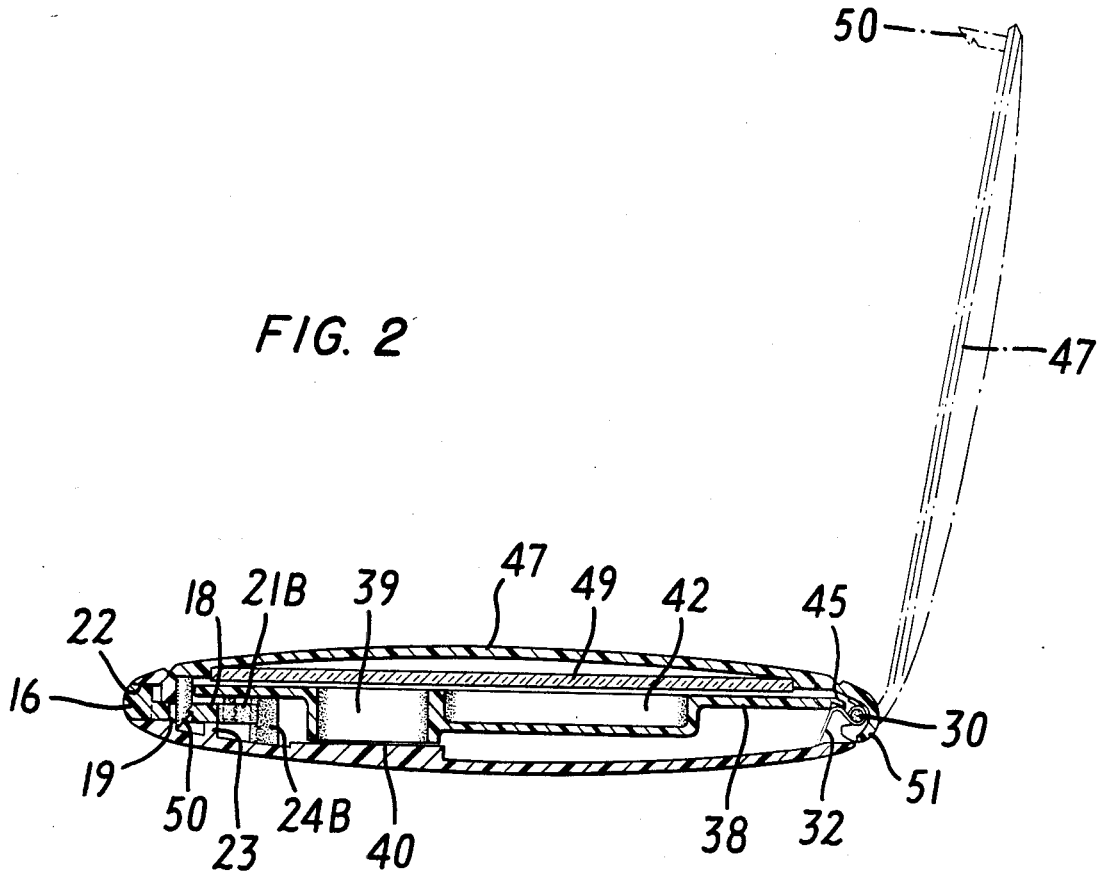
FIG. 2 is a cross-section of the compact in its closed position and shows in phantom the cover in the open position.

With reference now to the drawings, as seen in FIG. 2 the compact 10, when closed, is essentially a flattened right circular cylinder with a diameter considerably larger than its height. The side walls as well as the top and bottom surfaces are curved to provide a smooth surface that is aesthetically pleasing.

Figure 3:
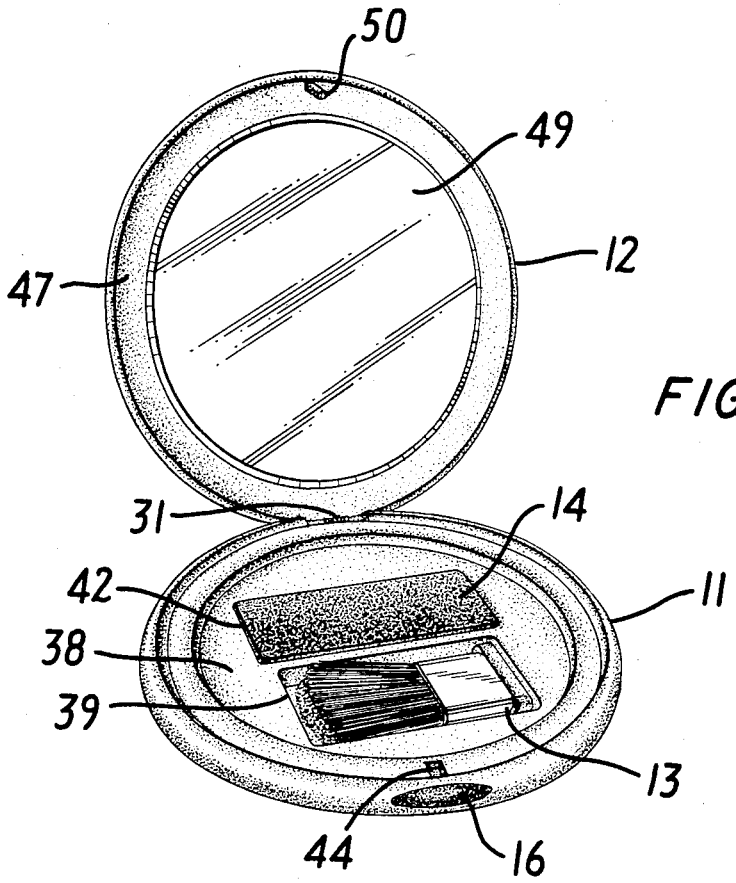
FIG. 3 shows in perspective the compact in its fully open position.

As best seen in FIG. 3, the compact comprises two main portions, the base or container portion 11 and the cover portion 12. The base portion is adapted to house the applicator 13, shown as a brush, and the cosmetic 14, each appropriately housed in the base as will be described more fully below. The mirror 49 is enclosed in the cover 12.

Figure 1:
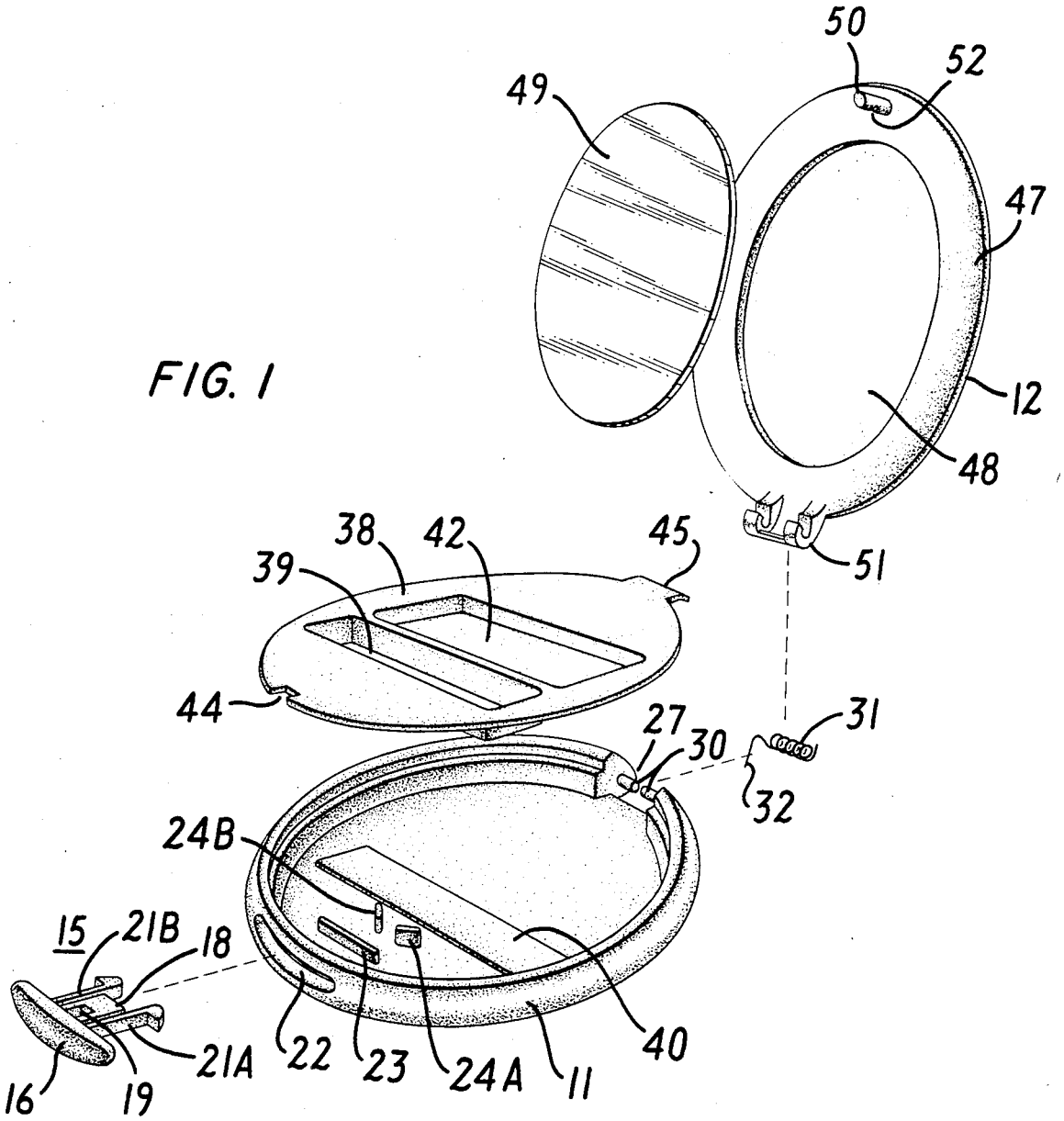
FIG. 1 is an exploded perspective view of the various elements of a compact in accordance with the preferred embodiment of the invention.

The base also includes a closure subassembly 15 which, as seen in FIG. 1, includes a button 16 that partially extends into an opening 22 in a side wall of the base and can be depressed to slide further into the opening. Integral with the button is a locking element 18 that includes an aperture 19 and the two runners 21A and 21B on opposite sides of the locking element. Advantageously, the closure subassembly described is formed of a plastic in a single mold. Each of the runners 21A, 21B includes a relatively flexible longitudinal leg portion and a stiffer enlarged end portion. For cooperating with this closure, the base member includes on its bottom a first vertical support or stop 23 over which slides the locking element 18 as the button moves back and forth. This stop serves primarily to provide vertical support to locking element 18 to insure that it maintains its desired horizontal orientation for reliable locking action and to guide runners 21A and 21B as the button is depressed. Additionally the base includes the pair of horizontal stops 24A, 24B, aligned to intercept runners 21A, 21B, respectively when the button is depressed and so to limit further depression. These stops are inclined in a direction to facilitate the sliding therealong of the enlarged ends of the runners and the forcing apart of their flexible legs as the button is manually depressed, thereby creating a tensing action favoring recovery of the button to its undepressed state when the manual pressure on it is removed.

Additionally, diametrically opposite the button opening 22 in the base member is the hinge opening 27 which is provided with a pin 30 which is split into two portions to permit insertion of the helical coil spring 31, whose opposite ends fit over and are held by the two pin portions. Extending from and continuous with one end of the coil spring 31 is an inverted V-shaped last turn portion 32 which, as best seen in FIG. 2, is adapted to be held under tension in the position shown when the cover is closed, so that as the locking pin is released, thus tension springs the cover at least partially open.

The base also includes the insert member 38 which is adapted to fit into the base. The insert includes the fully open region 39 which is adapted to fit over the raised platform 40 in the bottom of the base and with it to define the housing for the applicator. The insert also includes the container region 42 which is designed to house the cosmetic. The insert also includes the slot 44 along its periphery to permit passage therethrough of the locking pin 50 for locking. Diametrically opposite the slot 44, is the curved lip 45, which is designed to overlie and hold in position the uppermost part of spring end portion 32, as best seen in FIG. 2.

As best seen in FIG. 1, the cover of the compact, includes a relatively flat wall 47 which is designed to recess smoothly into the wall of the base. As best seen in FIG. 2, the base wall is slightly ridged to provide a shoulder for the cover when the compact is closed. Additionally, the cover wall 47 is ridged to provide a shoulder for the mirror 49 into which it is press fitted, as best seen in FIG. 2.

The wall 47 also supports the locking pin 50 which is aligned to fit through the opening 44 in insert 38 and through the opening 19 in the locking element 18 of the closure subassembly. The pin is provided with a tapered end, as seen in FIG. 2, which facilitates its moving past the opening 19 in locking element 18 when closing forces are being applied. As the pin passes, the closure assembly gives and moves inward, as though the button were being depressed. However, in the process there is stored up energy in flexing of the legs 21, 21B of the runners, and this energy thereafter restores the closure assembly to its normal undepressed state in which the locking element 18 pushes outwardly against the pin, holding it so that the compact stays closed. The surface of the pin advantageously includes the notch 52 (FIG. 1) into which fits an edge of the aperture in the locking element to achieve the locking action. Depression of the button moves the edge of the locking element out of the notch, freeing the pin and permitting springing open of the cover. The stop 23 serves to support the locking element against deflection as the locking pin 50 is pushed through for better locking action.

The wall 47 of the cover also includes its portion of the hinge, which comprises the two C-sections 51 adapted to fit over the spring 31 and to enclose the insert lip 45 so that end 32 of the spring is put into tension upon closing. Upon opening, this tension will overcome gravity and provide springing action to snap the compact at least partially open, as discussed.

It can be appreciated that many of the details of the illustrative embodiment described can be varied without departing from the spirit and scope of the invention. For example, the shape, relative sizes, and the materials used are to a considerable extent matters of choice.

Moreover, for more secure closure, it is feasible to employ a pair of closures of the kind described at diametrically opposed regions of the periphery compact and to include the hinge at a region of the periphery midway between such two closures.

What is claimed is:

1. A compact comprising a cover portion, a base portion, means for hinging the cover to the base, and closure means for opening and closing the compact, characterized in that the closure means includes a subassembly comprising a button, an apertured locking element, and a pair of runners, one on each side of the locking element and each including a relatively flexible longitudinal leg portion and a stiffer enlarged end portion, the locking element and the runners being integral with the button for movement with it, stopping means and vertical support means in the bottom of the base portion, and a pin in the wall of the cover, the runners being aligned so that when the button is depressed the enlarged end portions abut the stopping means, the locking element passes over the vertical support means for vertical support, and the leg portions of the runners are flexed by the abutment for storing energy for restoring the button to its updepressed state when released, and the pin being aligned with the aperture in the locking element so that the cover is held by the locking element to be released when the button is depressed.

2. A compact in accordance with claim 1 in which the means for hinging the cover to the base includes a helical coil spring which is compressed when the cover is in the closed position for providing a force which biases as the cover to the open position.

3. A compact in accordance with claim 2 further characterized in that the base portion wall includes an opening in which are provided a pair of spacecd pins between which extends said coil spring, said coil spring including a V-shaped end portion which is compressed by closing the cover over the base.

4. A compact in accordance with claim 3 in which the base portion includes an enclosure containing cosmetics and an enclosure supporting an applicator, and the cover supports a mirror.

5. A compact in accordance with claim 4 in which the compact is essentially a right circular cylinder with curved surfaces with a height considerably less than its diameter.

* * * * *